US006417751B1

(12) United States Patent
Yamaguchi

(10) Patent No.: US 6,417,751 B1
(45) **Date of Patent: *Jul. 9, 2002**

(54) SUPERCONDUCTING CONDUCTOR SYSTEM

(75) Inventor: Sataro Yamaguchi, Nagoya (JP)

(73) Assignee: Kabushiki Kaisha Y.Y.L., Gifu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/740,678

(22) Filed: Oct. 31, 1996

(30) Foreign Application Priority Data

Nov. 1, 1995 (JP) ..... 7-308237
Dec. 8, 1995 (JP) ..... 7-345678

(51) Int. Cl.[7] ..... H01F 6/00

(52) U.S. Cl. ..... 335/216; 505/879; 336/175; 361/19

(58) Field of Search ..... 336/175, 176, 336/DIG. 1; 335/216; 361/19; 327/527; 338/325; 505/116, 843, 844, 845, 879

(56) References Cited

U.S. PATENT DOCUMENTS 3,094,628 A * 6/1963 Jiu ..... 335/216
3,292,021 A * 12/1966 Hoag ..... 310/10
3,368,137 A * 2/1968 Kennard et al. ..... 336/175

(List continued on next page.)

FOREIGN PATENT DOCUMENTS

| | | |
|---|---|---|
| EP | 0 322 298 A1 | 9/1989 |
| JP | 62196804 | 2/1986 |
| JP | 06223641 | 1/1993 |
| JP | 8-1053547 A | 6/1996 |

OTHER PUBLICATIONS

Takahashi et al., "Chromium Plating Thickness Dependency of Cable–in–Conduit Conductor on Coupling Loss", 1994 Mtg. of Low–Temperature Superconducting Assoc. A–3–6, p. 225.

Ando et al., "Analysis of Current Imbalance in the Presence of the Contact Point within the Twisted Super–conducting Conductor for AC and Pulses", 1994 Mtg. of Low–Temperature Superconducting Assoc., E1–22, p. 119.

Koizumi et al., "Phenomenon of Current Imbalance in 30KA Grade NbTi Conductor", 1994 Mtg. of Low–Temperature Superconducting Assoc., A3–10, p. 229.

Toida et al., "On the Quenching Characeristics Upon AC Conduction in Twisted Superconducting Conductor for AC", 1994 Mtg. of Low–Temperature Superconducting Assoc., A3–3, p. 222.

Tsuchioka et al., "Analysis of Current Imbalance Between Strands in Cable Conductor", 1994 Mtg. of Low–Temperature Superconducting Assoc., E1–24, p. 121.

Ando et al., "Experimental Researches Concerning Current Imbalance Flowing in Twisted . . . ", 1994 Mtg. of Low-Temperature Superconducting Assoc., Society fo Electricity, vol. 115–A, No. 3, 1995, pp. 233–238.

Schermer et al., "Current Sharing Between Insulated Strands in a Superconducting Cable", 1994 Mtg. of Low–Temperature Superconducting Assoc., Adv. Cryog. Eng. vol. 26 (1980), pp. 559–607.

*Primary Examiner*—Ramon M. Barrera
(74) *Attorney, Agent, or Firm*—Morrison & Foerster, LLP

(57) ABSTRACT

In a superconducting coil system an m×n array of wound cores are arranged and n pairs of strands, totalling at 2n strands, are passed in pairs through the hollow center of the cores so that the current will flow in mutually opposite directions in each paired strands. The system can reduce AC loss, completely avoiding current imbalance in strands and being designed easily.

18 Claims, 12 Drawing Sheets

U.S. PATENT DOCUMENTS 4,021,729 A * 5/1977 Hudson, Jr. ..... 324/51
4,045,823 A * 8/1977 Parton ..... 361/58
4,205,288 A * 5/1980 Lin et al. ..... 336/5
4,263,549 A * 4/1981 Toppeto ..... 324/127
4,348,708 A * 9/1982 Howell ..... 361/45
4,665,357 A * 5/1987 Herbert ..... 323/361
5,223,789 A * 6/1993 Katsuyama et al. ..... 324/127

* cited by examiner

SUPERCONDUCTING CONDUCTOR SYSTEM

TECHNICAL FIELD OF THE INVENTION

This invention relates to a superconducting coil system and, more particularly, to a technique of suppressing and reducing generation of current imbalance in a superconducting strand.

BACKGROUND

FIG. 1 shows, in a cross-section, an illustrative cable-in conduit conductor (CICC) constituting a conventional superconducting coil system.

Referring to FIG. 1, the cable-in-conduit conductor is comprised of tens to hundreds of yarned (or twisted) superconducting strands packed in a stainless steel conduit in the form of a pipe.

In a cable-in-conduit conductor, the void ratio, representing the ratio of an area in a cross-section excluding an area occupied up by the strands, is usually set to approximately 35 to 37% (see Takahashi et al., "Chromium Plating Thickness Dependency of Cable-in-conduit Conductor on Coupling Loss", . Extended Abstract to the 52nd Autumn Meeting of 1994 of Low-Temperature Superconducting Association [Teion Kogaku Chodendo-Gakkai], A3–6, page 225, 'literature 1').

The liquid helium (He) or supercritical He is allowed to flow between these strands to cool the strands to permit the current to flow therein in a superconducting state.

The conduit performs the role of securing a flow channel for He, in addition to the role of supporting the gigantic electro-motive force exerted on the conductor.

FIG. 2 shows an illustrative method for producing this sort of the CIC conductor.

Referring to FIG. 2, each strand is of a diameter of 0.76Φ [mm] and has embedded in the mid portion thereof a superconducting filament formed of copper and NbTi, $Nb_3Sn$ or the like.

In the embodiment of FIG. 2, three such strands are twisted together to form a sole twisted yarn. Three such twisted yarns are twisted together to form a sole twisted wire. This operation is repeated twice resulting in a twisted cable, and ultimately six resultant cables are accommodated within a 23.0×27.6 mm sized conduit.

Thus, in the embodiment of FIG. 2, 3×3×3×3×6=486 strands are used.

There are several reasons of using a large number of twisted yarns.

One of such reasons is reducing AC loss. Eddy current flows on the surface of a conductor placed in an AC circuit or in a changing magnetic field as time lapses. This phenomenon is known as the skin effect.

The surface of the strand is formed of copper, as shown in FIG. 2. Thus the eddy current is apt to flow on the strand surface such that heat is evolved by the resistance of copper to detract from stability of the superconducting coil. Therefore, a strand of small diameter is used for reducing the eddy current loss.

Meanwhile, if the characteristic depth (penetration depth) of the skin effect is δ and the strand diameter is d, a designing standard is given by the following inequality:

$$d<\delta \tag{1}$$

The strand of such fine diameter is satisfactorily compatible with machining NbTi or the like into a filament.

Another reason of twisting (or yarning) a number of strands is that, since the conductor is intended for fabricating a coil, a bending operation is required.

If the strand is not twisted, it is poor in bendability and might occasionally encouter fracture.

During coil production, a coil is bent in one direction, as a result of which the coil length as measured on its inner diameter side differs from that as measured on its outer diameter side.

If the strand would be not twisted, it would be stretched on its outer diameter side while being contracted on its inner diameter side.

The twisting operation is performed for preventing lowering of superconductor characteristics due to such non-symmetrical structure.

The CIC conductor, thus fabricated, is wound to a predetermined shape for producing a coil.

If the coil is used for an AC circuit or the like, it is preferred that the strands be electrically insulated from one another for the above reason. The reason is that, if the surfaces of the strands are electrically connected to one another, the plural strands can be regarded as a conductor with a larger surface area and a larger volume, so that the eddy current loss W is increased. The eddy current loss is proportionate to the square of the characteristic size such that $$W\ d^2 \tag{2}$$

In the above equation (2), W represents the eddy current loss and d represents the strand diameter.

Since there are, in effect, a large number of contact portions in a sole strand, the eddy current flows in a complex pattern.

For the above reason, in preparing an NbTi-30KA grade coil (DPC-U) by a CIC conductor in the demonstration poloidal coil (DPC) project of Japan Atomic Energy Research Institute, referred to hereinafter as JAERI, each strand is insulated by Formvar insulation.

That is, the surface of the strand shown in FIG. 2 is coated with a Formvar insulating material to a thickness of several micrometers (see FIG. 3). By coating the strand surface with the insulator, the individual strands are insulated satisfactorily from one another.

By employing such structure, a superconductor coil of high stability and low eddy current loss with only little AC loss have been expected to be producible. In the case of a superconductor coil used in an AC circuit, although the AC losses may be enumerated by hysteresis loss and proximity effect loss etc., in addition to the eddy current loss, the eddy current loss is predominant among these AC losses.

PROBLEM TO BE SOLVED BY THE INVENTION

However, experiments on DPC conducted by the JAERI was not successful, as will now be explained.

Before an experiment on passing the AC current, an experiment was conducted using a pulse-shaped current waveform (see FIG. 4). Due to excitation of a sole coil, the waveform of the magnetic field generated by the coil is analogous to FIG. 4.

Consequently, the rate of change of the magnetic field (flux density) dB/dt during a time period 0 to $t_1$ (time differential of magnetic field) is found. In an experiment, the time from 0 to $t_1$ is controlled by an external power source and the rate of change of the magnetic field dB/dt was varied for finding data such as stability of the superconducting coil.

Thus it was found that, in this superconducting coil, the value of the rate of change of the magnetic field dB/dt which permits stable operation was approximately one thousandth of the initial design value.

It was intended at the outset to achieve a world record in connection with the rate of change of magnetic field dB/dt. However, in fact, the coil quenching occurred at a value of the rate of change of magnetic field dB/dt which was significantly lower than that with the conventional coil.

The reason therefor was checked precisely by researchers of the JAERI, manufacturers and universities. It was found that the currents flowing in the individual strands are not the same but large current imbalance exists. The results of the analysis are substantially as follows:

FIG. 5 shows an equivalent circuit in case two strands are used.

Referring to FIG. 5, $L_1$ and $r_1$ denote self-inductance and resistance of strand 1, $L_2$ and $r_2$ denote self-inductance and resistance of strand 2, respectively, and M denotes mutual inductance.

The circuit network equation is given by the following equations (3) and (4):

$$V=r_1\cdot i_1+j\omega L_1\cdot i_1+j\omega M\cdot i_2 \quad (3)$$

$$V=r_2\cdot i_2+j\omega L_2\cdot i_2+j\omega M\cdot i_1 \quad (4)$$

In the above equations, ω and j denote the oscillation frequency of the circuit and an imaginary number of $j^2=-1$, respectively.

By solving the equations (3) and (4) with respect to the currents $i_1$, $i_2$, the following equation (5) is derived:

$$\frac{i_1}{i_2}=\frac{r_2+j\omega(L_2-M)}{r_1+j\omega(L_1-M)} \quad (5)$$

Since the strand is in the superconducting state, $r_1=r_2=0$ in the equation (5), and thus the current ratio of the two strands is given by the equation (5'):

$$i_1/i_2=(L_2-M)/(L_1-M) \quad (5')$$

As will be understood from the explanation of the method for producing the CIC conductor of FIG. 2, since the stands are wound tightly each other, the mutual inductance M assumes a value which is extremely close to the self-inductance $L_1$ or $L_2$.

In addition, the self-inductance $L_1$ is not completely equal to the self-inductance $L_2$ and the two values usually differ slightly from each other.

The results of measurement on DPC conducted by the JAERI have revealed that fluctuations in the self-inductance were not more than approximately 1% and that the value of mutual inductance was on an order of 99% of the value of self-inductance. Substituting this into the above equation (5'), the following equation (6) is derived:

$$i_1/i_2=(101-99)/(100-99)=2/1 \quad (6)$$

Thus it is seen that a minor difference in inductance doubles the current ratio between different strands.

On the other hand, there is a critical current $I_c$ for the current flowing in the strand, such that, if the current exceeding a pre-determined value flows, quenching occurs.

That is, in the case of the above-described DPC arrangement of the JAERI, such quenching is produced if the current in several of the entire of 486 strands exceeds the critical current $I_c$.

This induces quenching of the entire coil, as a result of which the value of the current that can be caused to flow stably was as low as approximately about one-thousandth of the value of the initially intended rate of change of magnetic field dB/dt.

The analysis of this phenomenon is vigorously researched at present and the results of the researches are being published in, for example, the following publications:

(1) Ando et al., "Analysis of Current Imbalance in the Presence of the Contact Point within the Twisted Superconducting Conductor for AC and Pulses", Extended Abstract to the 52nd Autumn Meeting of 1994 of Low-Temperature Superconducting Association, E1–22, page 119, 'literature 2').

(2) Koizumi et al., "Phenomenon of Current Imbalance in 30KA grade NbTi Conductor", Extended Abstract to the 52nd Autumn Meeting of 1994 of Low-Temperature Superconducting Association, A3–10, page 229, 'literature 3').

(3) Toida et al., "On the Quenching Characteristics upon AC Conduction in Twisted Superconducting Conductor for AC", Extended Abstract to the 52nd Autumn Meeting of 1994 of Low-Temperature Superconducting Association, A3—3, page 222, 'literature 4').

Of these, Koizumi et al.(JAERI) point out in the literature 3 the possibility of the current as much as 7.1 times the mean current value having flown through several strands due to cooling medium temperature dependency of the quenching current value. It is estimated that, in a DPC-U conductor, disturbance in self-inductance of the strand is estimated to be 0.12%, or 0.06% in strand length.

Based on the results of the above analysis, the strand surface of the recently produced CIC conductor is plated with chromium, as shown in FIG. 3, instead of Formvar insulation.

If the strand surface is plated with chromium, the strands are not insulated satisfactorily from one another, so that the eddy current loss is increased, as explained previously. However, the eddy current loss incurred is smaller than the case where the copper surface remains by itself because chromium is lower in electrical conductivity than copper.

On the other hand, if the current in some strands exceeds the critical current due to current imbalance in the strands, quenching is initiated. In general, quenching is initiated at a certain portion of the strand.

Since an electrical voltage is generated due to electrical resistance at the strand portion where quenching has occurred, current diversion or commutation (current splitting) occurs from the contact portion of the chromium plating to another element (strand).

FIG. 6 shows the manner of current splitting due to the quenching in two strands. In FIG. 6, $R_1$ denotes a resistance caused by quenching generated due to a current exceeding the critical current $I_c$, and $R_c$ denotes a contact resistance of the chromium plating.

The current $I_1$ flowing in a strand 1 is split at the quenching portion in amounts determined by resistances $R_1$, $R_c$. The larger the resistance $R_1$, the larger is the proportion of the current flowing in strand 2.

In effect, this phenomenon occurs between a number of strand pairs. By such current splitting, the strand currents are rendered uniform to enable the coil to be driven stably.

However, if such structure is used, it becomes necessary to check the thickness of the chromium plating or current diversion dependent upon the thickness of the chromium plating. This complicates the analysis and necessitates experiments. Thus study is described in the above literatures 1 and 4 and in the following literature.

Tsuchioka et al., "Analysis of Current Imbalance between Strands in Cable Conductor", Extended Abstract to the 52nd Autumn Meeting of 1994 of Low-Temperature Superconducting Association, E1–24, page 121, 'literature 5').

After all, the gist of this line of investigations resides in the following: that because of current imbalance in the strands, it is crucial in designing the CIC conductor to adjust chromium plating etc. depending on the design requirements for the coil, although the eddy current loss could be reduced by complete insulation.

However, no satisfactory designing method for making adjustment of chromium plating in accordance to the design requirements required of the coil has been established to date.

If the superconducting strands are electrically insulated from one another, as explained above, the strand circuit forms a parallel circuit, thus producing current imbalance resulting in quenching.

A superconducting strand is formed by fine wires of superconductor, such as NbTi, embedded in copper or the like. As the case may be, the strand surface is coated with an insulating material, such as Formvar etc., or plated with Ni or formed of copper itself.

The current imbalance is induced in a strand by the fact that the self-inductance and the mutual inductance between the strands differ from one another slightly, that is by up to about 1% or less, and that, since the circuit is a superconducting circuit, the resistance components scarcely exist in the circuit. Detailed discussions on this subject are found in S. Ando et al., "Experimental Researches Concerning Current Imbalance Flowing in Twisted Superconductors for Large AC and Pulse Current", thesis presented to Society of Electricity [Denki-Gakkai Ronbunshi] A, pages 223 to 238, vol.115-A, No.3, 1995 'literature 6'.

SUMMARY OF THE DISCLOSURE

In light of the above, the present inventor has proposed in JP Patent Application No. 6-316071 a method of eclectrically insulating the individual strands of current leads of a superconducting coil system and connecting them to respective superconducting strands.

With the method proposed in the above JP Patent application 6-316071, the resistances of the current leads are inserted in the electric circuit of the superconducting strands, thus eliminating the current imbalance.

With the proposed method, since the strand temperature ranges from room temperature to low temperature, the resistance of the current leads necessarily exist unless a material which becomes superconducting at room temperature is found.

In the present-day designing of the current leads, the above proposed method overcomes the current imbalance in the strands to assure stable operation of the superconducting coil, taking into account parameters of the superconducting magnets energy storage system (SMES) thought to be the largest market for application of the superconducting coil for domestic (commercial) application.

However, the current imbalance cannot be prohibited with the commercial frequencies (60 Hz to 50 Hz) by the resistance of the current lead.

The superconducting coil is used because it has no electrical resistance (electrical resistance=0). In future research and development, the target will necessarily be to lower the resistance of the current lead portions.

Since the major portion of the electric power is utilized at a commercial frequency, it is desirable that the superconducting coil be usable at the commercial frequency.

Consequently, the superconducting coil needs to be driven at the commercial frequency. In addition, for stable driving, it is essential to prevent the current imbalance in the superconducting strands.

The present invention has been made on the basis of the above-described recognition acquired by the present inventor. It is an object of the present invention to provide a superconducting coil system which can be driven at a commercial frequency and which prohibits the current imbalance from being produced. Further objects will become apparent in the entire disclosure.

For accomplishing the above object, the present invention provides a superconducting conductor or coil system characterized in that two strands are arranged so as to pass through a hollow portion of a substantially cylindrical hollow magnetic member so that the current will flow in the strands in mutually opposite directions.

Also, according to the present invention, n pairs of strands totalling at 2n strands are preferably arranged as pairs so as to pass through hollow portions of an n×n (generally m×n) array of substantially cylindrical hollow magnetic members so that the current will flow in each strand pair in mutually opposite directions.

Further, according to the present invention, n pairs of strands totalling at 2n strands are preferably arranged as pairs so as to pass through hollow portions of a 2-row by n-column array of substantially cylindrical hollow magnetic members so that the current will flow in each pair of said strands in mutually opposite directions.

According to the present invention, the above strands are driven by a power source of a commercial frequency.

Moreover, according to the present invention, a plurality of, herein 2n, lead wires making up current leads are connected, without being bundled together, to 2n stands arranged for passing through the hollow portions of the substantially cylindrical hollow magnetic members (i.e., cores) arranged in an n×n (generally m×n) array configuration.

According to the present invention, iron cores or ferrite cores are used, which are usually termed as wound core and prepared by coaxially winding a large number of thin sheets to form a hollow portion, as shown in FIG. 7. That is, the wound core has a center through-hole and substantially cylindrical in shape.

A plurality of cores shown in FIG. 7 are used and arrayed preferably in a matrix configuration as shown in FIG. 8.

Referring to FIG. 8, 3×3=9 cores are arranged in a matrix configuration. A plurality of, herein six, strands are numbered from (1) to (6) as shown. The current is denoted by solid lines interconnecting the same strand numbers and flows from above towards below in the drawing.

Two strands are passed through the hollow portions of the core. The current directions in the two strands in the same through-hole are opposite to each other.

If the configuration shown in FIG. 8 is used, 2n strands are used for $n \times n = n^2$ cores, (in general, m×n cores).

According to the present invention, the current imbalance between strands can be suppressed and decreased to a negligible level, while driving becomes possible with a commercial power source, as will be explained subsequently.

If the strands are electrically insulated from one another, the strand portions passing through the cores need not be in the superconducting state. For example, these strand portions can be at near the temperature of liquid nitrogen. In such case, copper wires, for example, in place of NbTi wires, are passed as strands through the core(s).

According to the present invention, if the cores are arranged as shown in FIG. 14 (2 rows×4 columns=2×n, n=4), preferably, 2n cores suffice for 2n strands.

Meritorious Effects of the invention can be summarized below, but not limited thereto. Further advantages will become apparent in the entire disclosure.

According to the present invention, as described above, there is achieved a meritorious effect that, since superconducting strand pairs through which flows the current in mutually opposite directions are arranged between cores, it becomes possible to suppress and reduce the current imbalance in the strands. According to the present invention, there is also achieved an additional advantage that the superconducting coil can be driven at the commercial frequency.

Moreover, according to the present invention, the cores through the hollow center of each of which a pair of strands pass, in which flows the current in mutually opposite directions, can be arranged in the n×n (generally m×n) configuration, or preferably in the 2×n configuration comprised of a still smaller number of cores for 2n strands, so that the core unit may be constructed as a unit of a volume significantly smaller than that of the superconducting coils.

In addition, since means for resetting the cores by the measurement lines for detecting the quenching of the strands is provided in the present invention, it becomes possible to stabilize the current supply through the strands.

PREFERRED EMBODIMENTS

The principle and the modes of carrying out the present invention will be explained in detail.

Figure 13:
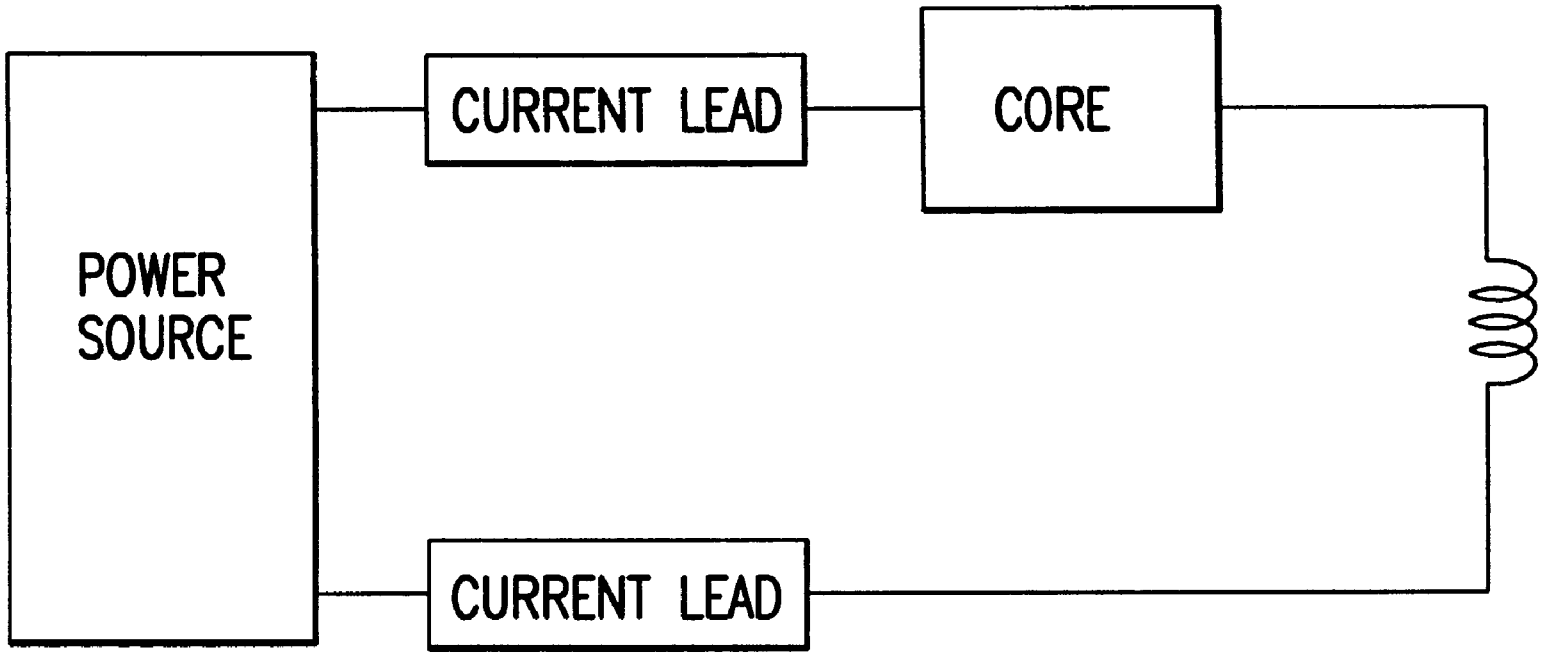
FIG. 13 illustrates an overall structure of a superconducting coil system inclusive of the core according to the present invention.

FIG. 13 schematically shows the overall structure of a superconducting coil system according to the present invention. Referring to FIG. 13, the superconducting coil system includes a power source for driving a superconducting coil 1, current leads for electrically connecting this power source to the superconducting coil 1, a core according to the present invention and a superconducting coil 1. In FIG. 13, cooling means for the superconducting coil by liquid helium or cooling means for the current lead are not shown.

In FIG. 13, the core system may be inserted anywhere between the superconducting coil and the current lead.

Figure 9:
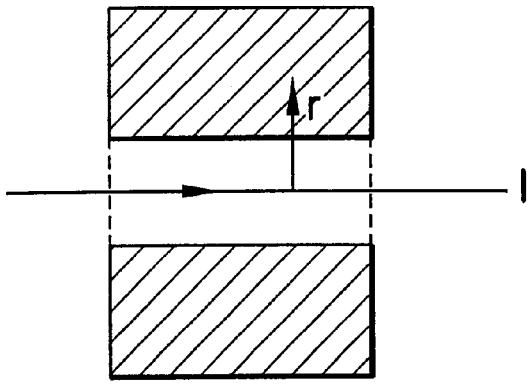
FIG. 9 illustrates the relation between the current and the magnetic field in the core.

FIG. 9 schematically shows the relation between the core, current and the coordinate.

Figure 1:
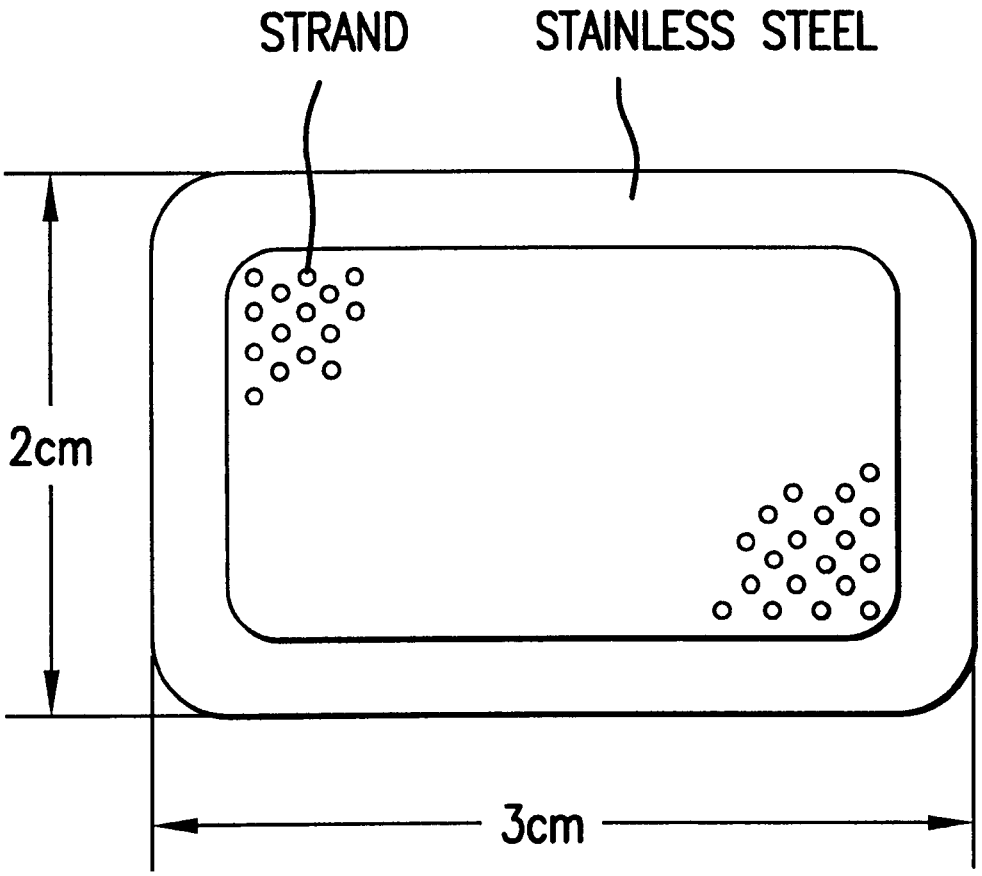
FIG. 1 PRIOR ART
FIG. 1 is a cross-sectional view for illustrating the structure of a conventional cable-in conduit conductor.
Figure 2:
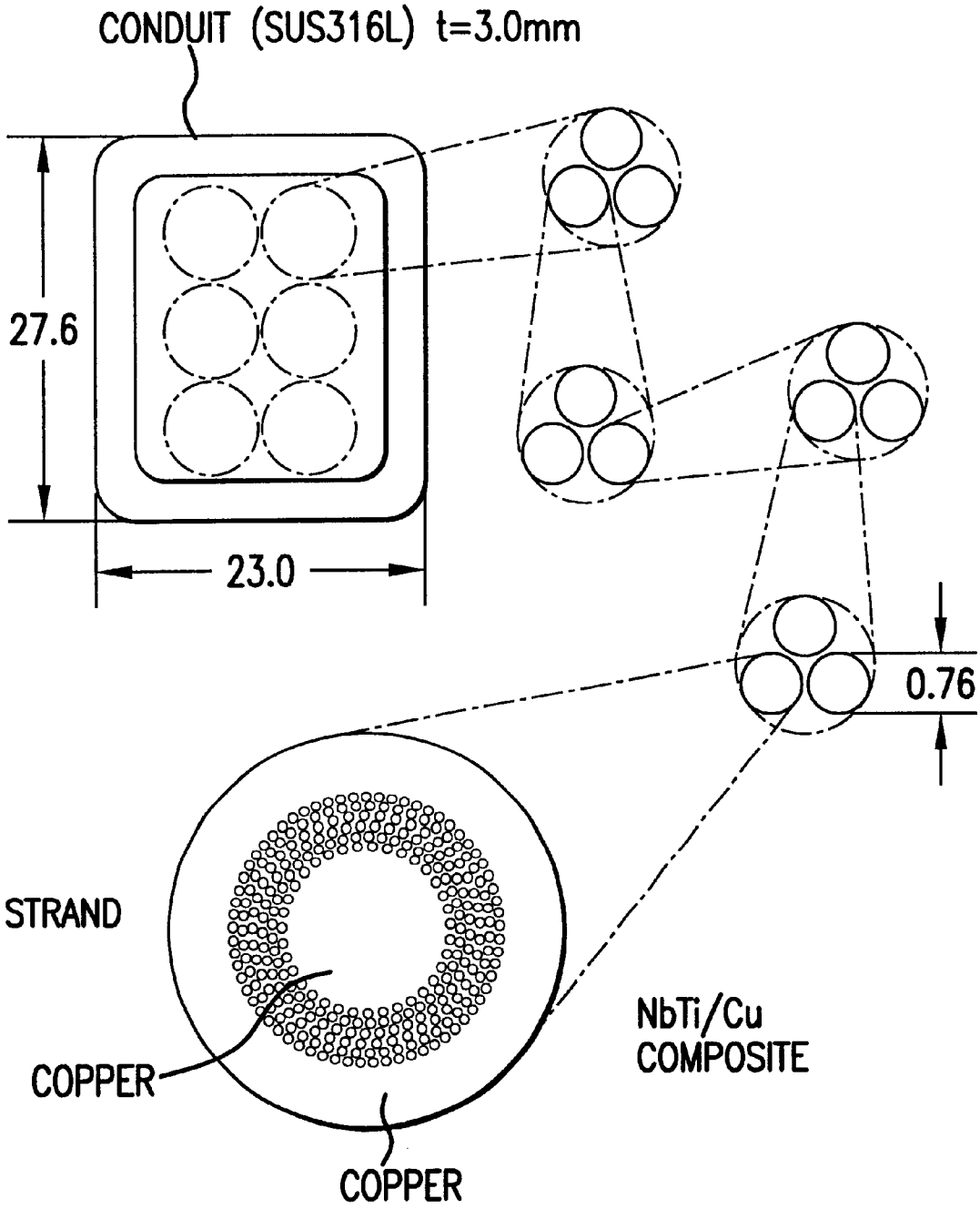
FIG. 2 illustrates a process for fabricating the cable-in-conduit conductor from strands.
Figure 3:
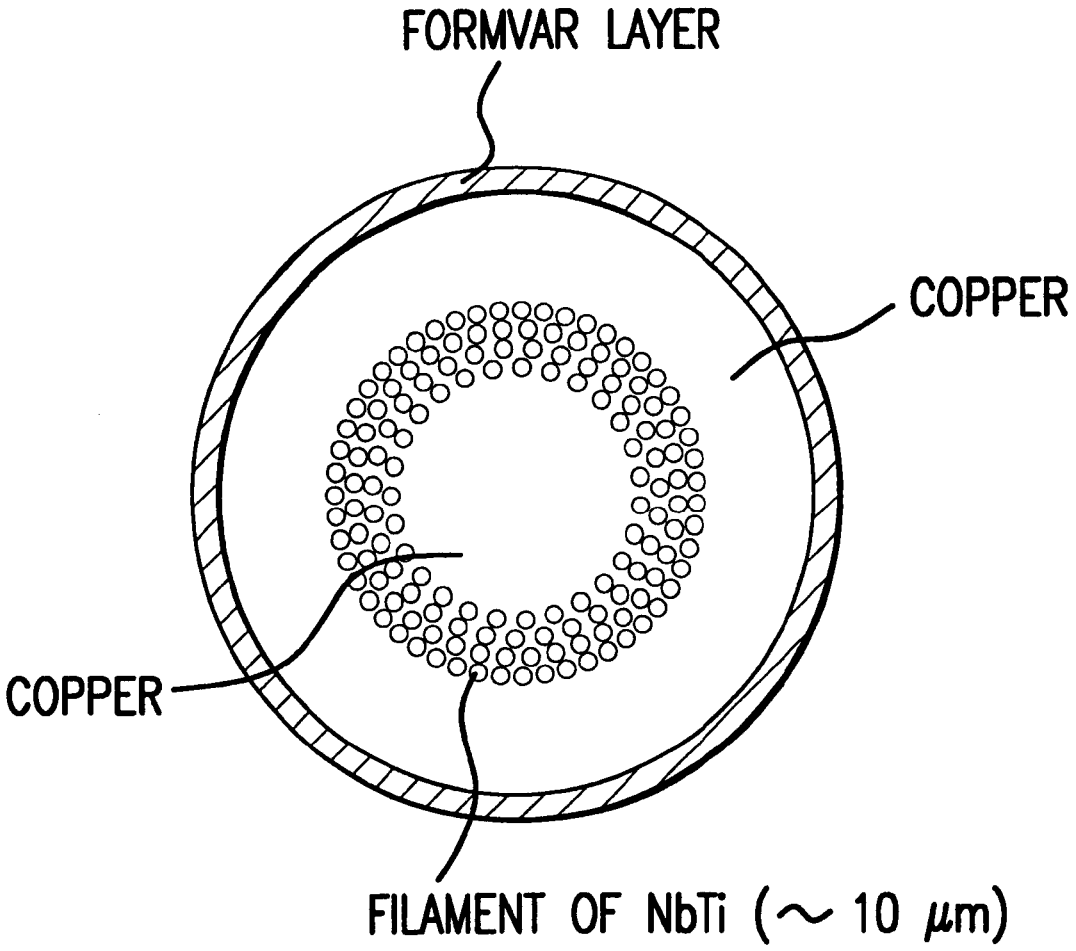
FIG. 3 shows a structure of a strand surface coated with an electric insulator.
Figure 4:
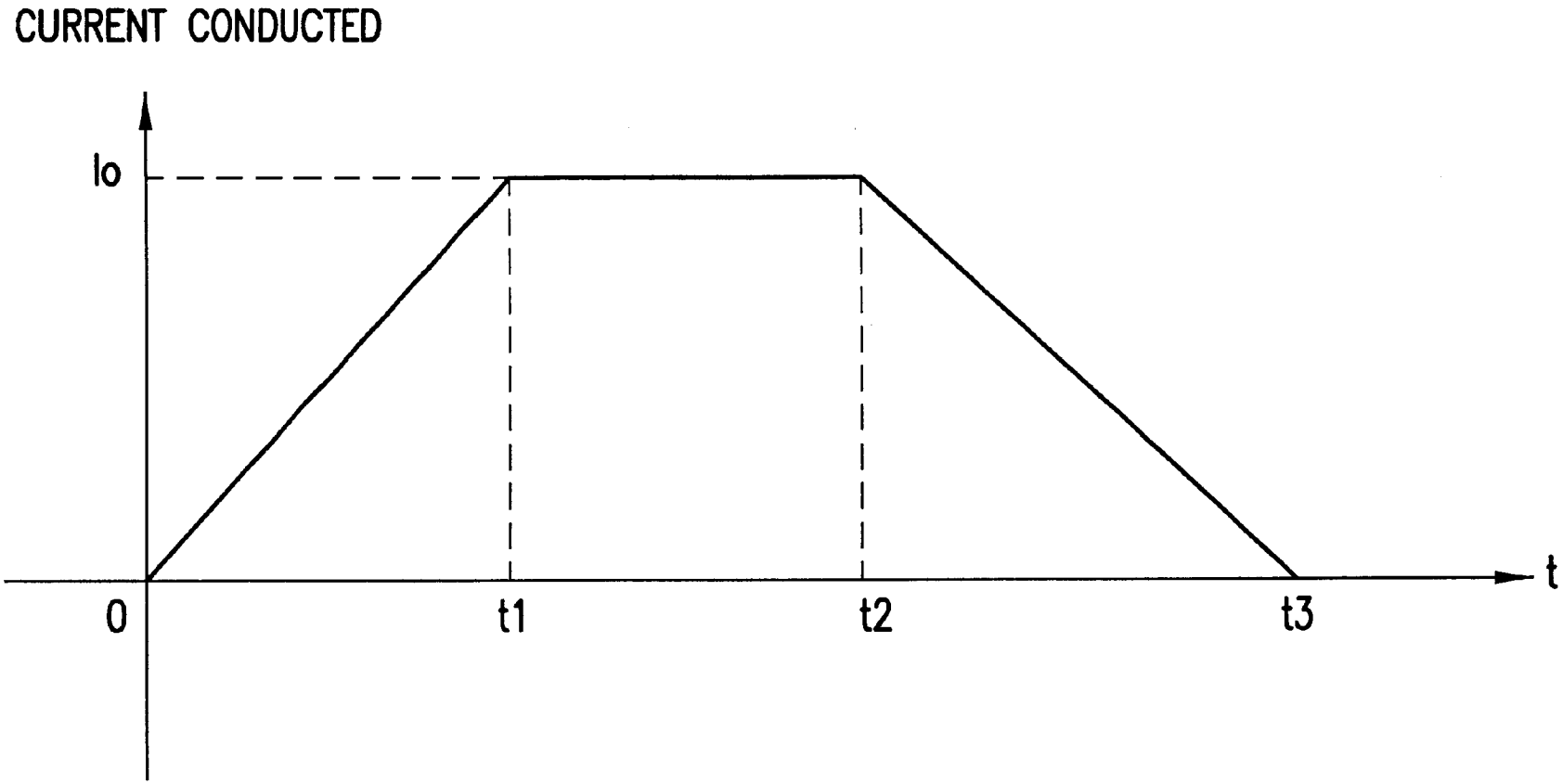
FIG. 4 illustrates a typical waveform of a current signal supplied through a strand.
Figure 5:
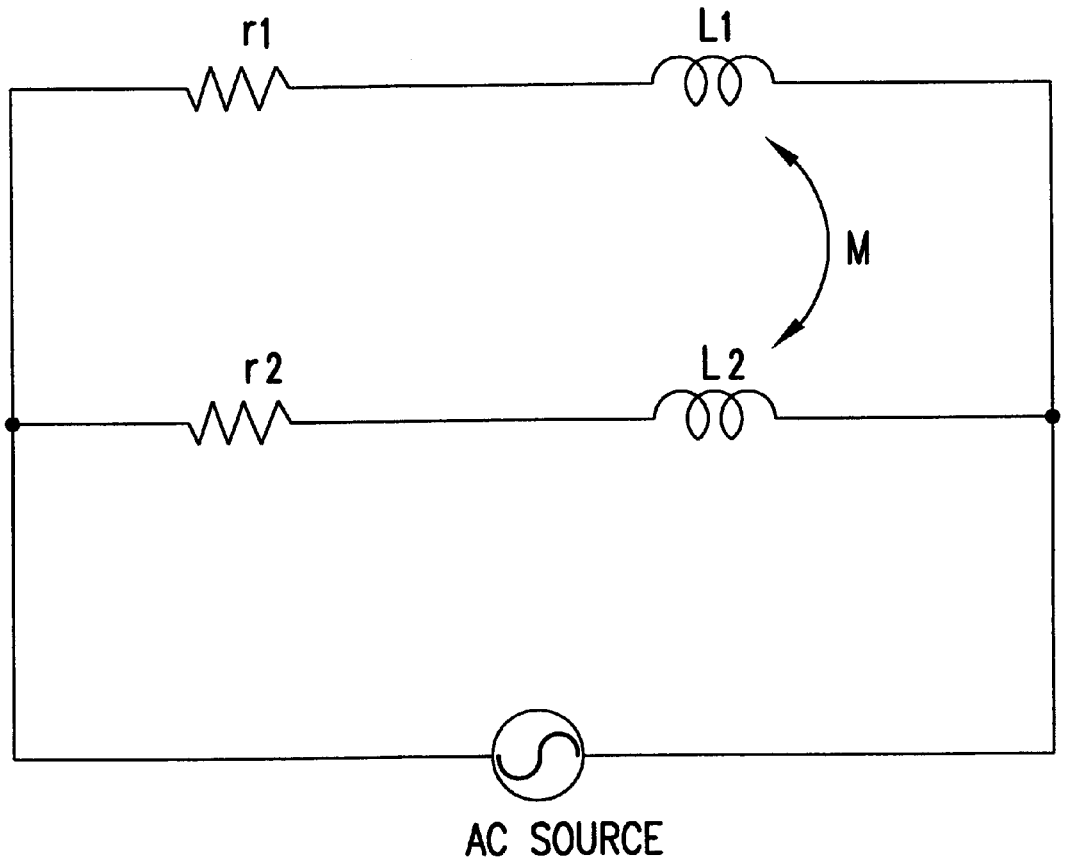
FIG. 5 shows an equivalent circuit of a simplified model employing two strands.
Figure 6:
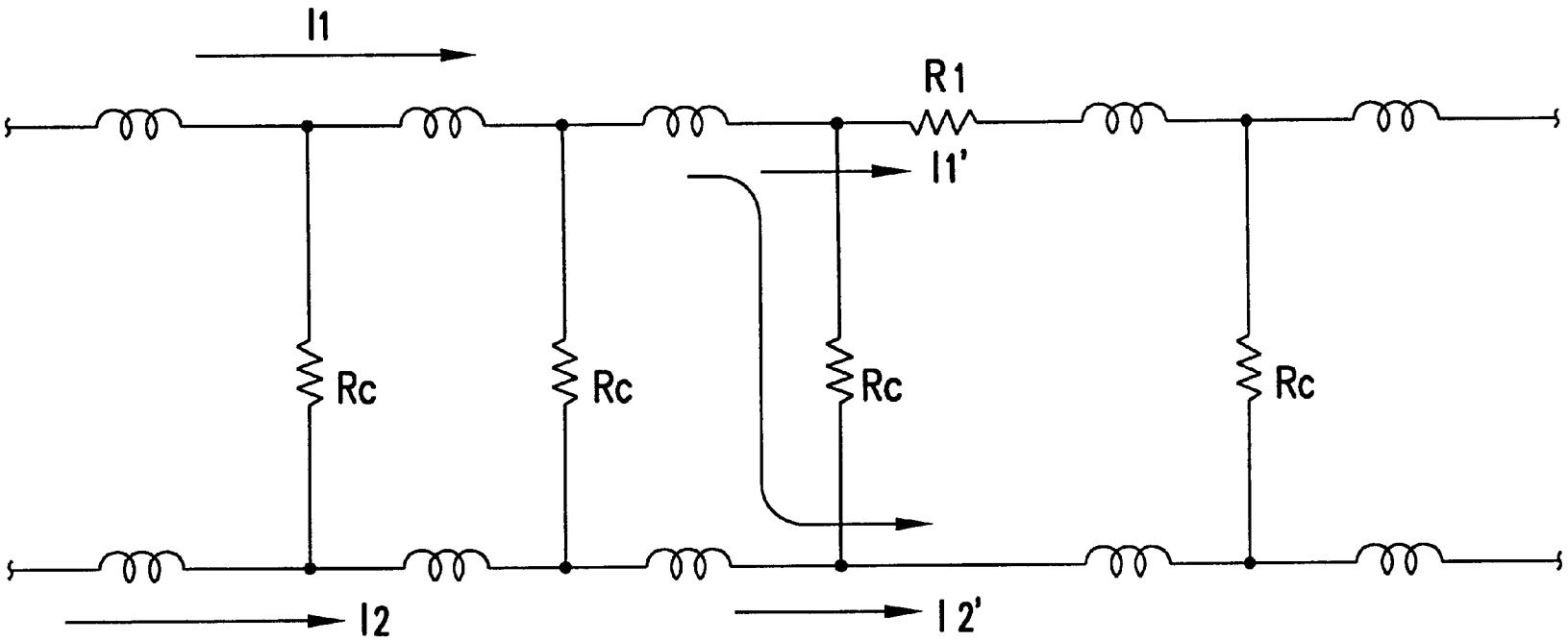
FIG. 6 shows the state of current splitting by quenching into two strands.
Figure 7:
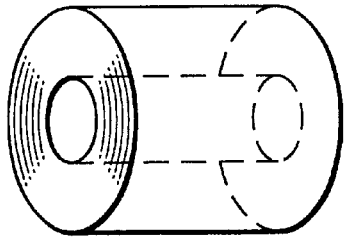
FIG. 7 schematically shows the shape of a core.

If the current I is caused to flow through the center of the core, a magnetic field H is generated by the current I. Referring to FIG. 3, I and r denote the current flowing through the center of the core and the distance from the center of the core, respectively. The magnetic field H is given by the equation (7):

$$H = \frac{I}{2\pi r} \tag{7}$$

If magnetic permeability of the core is denoted by $\mu$, the magnetic flux density B is induced in the core by the magnetic field H as shown by the equation (8):

$$B = \mu H = \frac{\mu I}{2\pi r} \tag{8}$$

Integrating the magnetic flux density B with the cross-sectional area S of the core, the magnetic flux $\Phi$ of the core is obtained, as shown by the equation (9):

$$\Phi = \int_S B\,ds = \int \frac{\mu I}{2\pi r}\,ds \tag{9}$$

Figure 10:
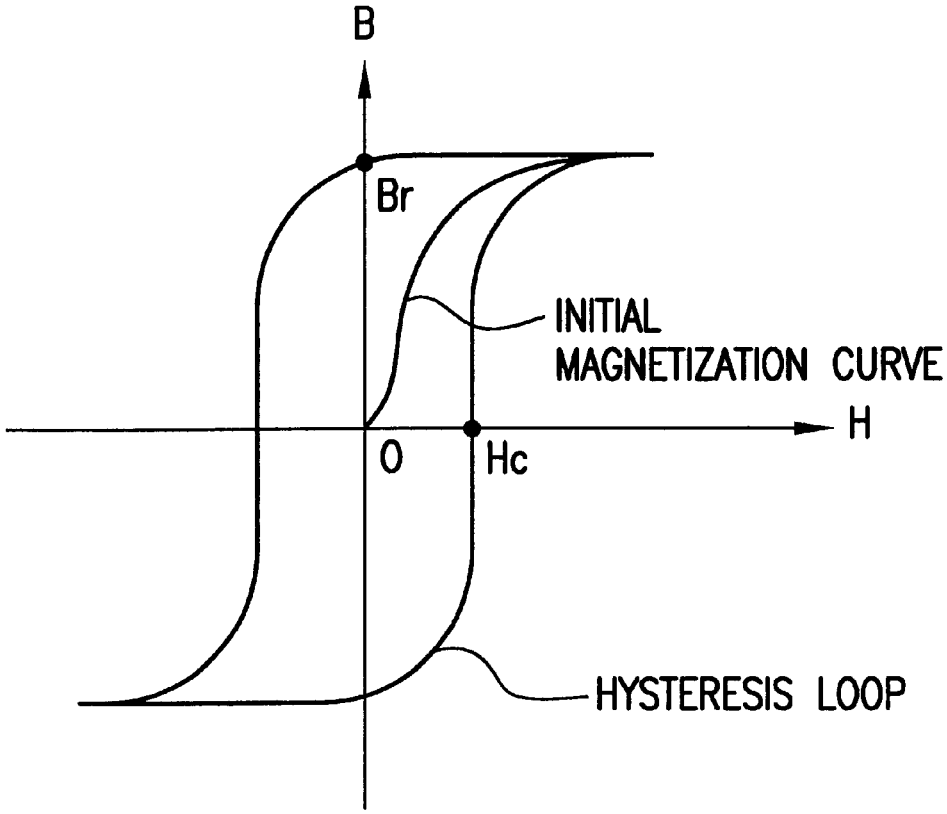
FIG. 10 shows a typical B-H curve.

In general, the characteristics of a magnetic material is represented by the B-H curve as shown in FIG. 10, where Br and Hc denote residual magnetic flux density and coercivity, respectively.

Initial magnetization starts at the origin O. Subsequently, the hysteresis proper to the magnetic material is displayed. Hc and Br are determined with the material. If the alternating current is allowed to flow, Hc is usually increased due to eddy current loss or the like.

With a material in general commercial use, the value of Hc is as given by the equation (10):

$$Hc = 30 \text{ A/m at } 1000 \text{ Hz}$$

$$Hc = 10 \text{ A/m at DC}$$

$$Br = 1.4 \text{ Tesla} \tag{10}$$

Figure 11:
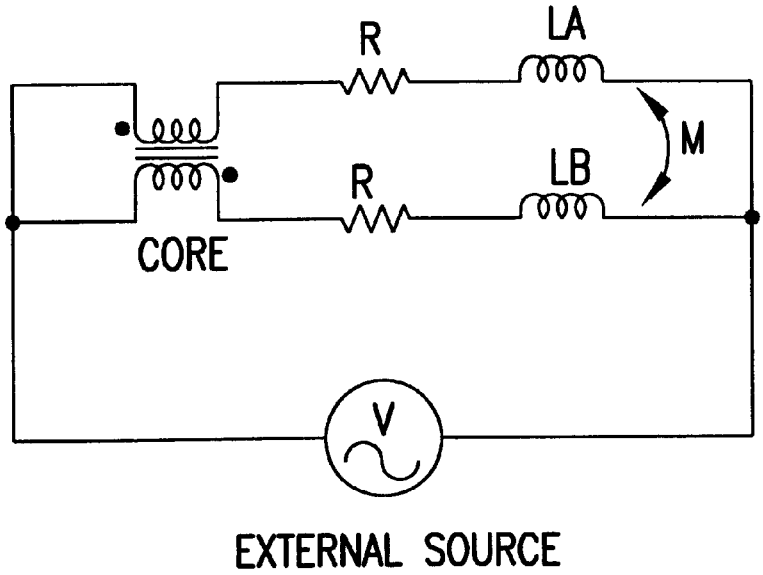
FIG. 11 shows an equivalent circuit of the structure of two strands arranged in the core.

For simplicity, a circuit composed of two strands is considered. In this case, only one core is used. FIG. 11 shows an equivalent circuit.

FIG. 11 is an equivalent circuit for the strands including a core. LA, LB, M and R denote self-inductance of strand A, self-inductance for strand B, mutual inductance and resistance of the circuit, respectively.

The circuit equations of the equivalent circuit shown in FIG. 11 are as shown by the equations (11) and (12):

$$\frac{d\Phi A}{dt} + LA\frac{dIA}{dt} + RIA = -M\frac{dIB}{dt} + V \tag{11}$$

$$\frac{d\Phi B}{dt} + LB\frac{dIB}{dt} + RIB = -M\frac{dIA}{dt} + V \tag{12}$$

In the above equations, IA, IB, V, ΦA and ΦB denote the current flowing in the strand A, current flowing in the strand B, an external source voltage, magnetic flux generated in the core by IA and the magnetic flux generated in the core by IB, respectively.

Since the two strands form the same coil, they have values of self-inductance which are close to each other, as represented by the equation (13):

$$LA \approx LB = LB - \delta L$$

where $$\delta L << LA,\ LB \tag{13}$$

Similarly, the mutual inductance M has a value close to the self-inductance LA, LB, and is given by the equation (14):

$$LA \approx LB \approx M \tag{14}$$

If the values of self-inductance LA and self-inductance LB are completely equal to each other, there is no current imbalance in the coil, thus assuring stable driving.

The differential current between the stands A and B is denoted by the equation (15):

$$\Delta I\,AB = IA - IB \tag{15}$$

Taking the difference between both sides of the equations (11), (12), the following equation (16) is derived:

$$(LA + M)\frac{d\Delta IAB}{dt} + R\cdot\Delta IAB = -\frac{d}{dt}(\delta L\cdot IB + \Phi AB) \tag{16}$$

In the above equation (16), ΦAB=ΦA−ΦB.

The initial conditions (t=0) for the equation (16) include ΔI AB=0, IB=0 and ΦAB=o.

In the left side of the equation (16), ΔI AB, (LA+M) and R may be deemed as current, inductance and resistance of the circuit, respectively, while the right side thereof may be deemed as an external source voltage. The right side of the equation (16) is now scrutinized further.

If several conductors of a strand are checked, the current is given by the equation (17):

$$IB \leqq 50 \text{ to } 120 \text{ A} \tag{17}$$

It is stated in R. I. Schermer and B. P. Turek, "Current Sharing Between Insulated Strands in a Superconducting Cable", Adv. Cryog. Eng.26, (1980), page 599 that fluctuations of the self-inductance are on an order of $10^{-5}$H, if the strand is produced appropriately.

Consequently, a model of two strands under consideration is given by the equation (18):

$$\delta L = 10^{-5}H = 10\mu H \tag{18}$$

If IB=50 A, the following equation (19) is derived:

$$\delta L\cdot IB = 5.0\times10^{-4}VS \tag{19}$$

Therefore, if the saturation magnetic flux Φmax is approximately $5.0\times10^{-4}$VS, the right side of the equation (16) can be set so as to be substantially equal to zero, such that the current difference ΔI AB can be deemed to be zero within a range of coercivity of FIG. 10.

Figure 12:
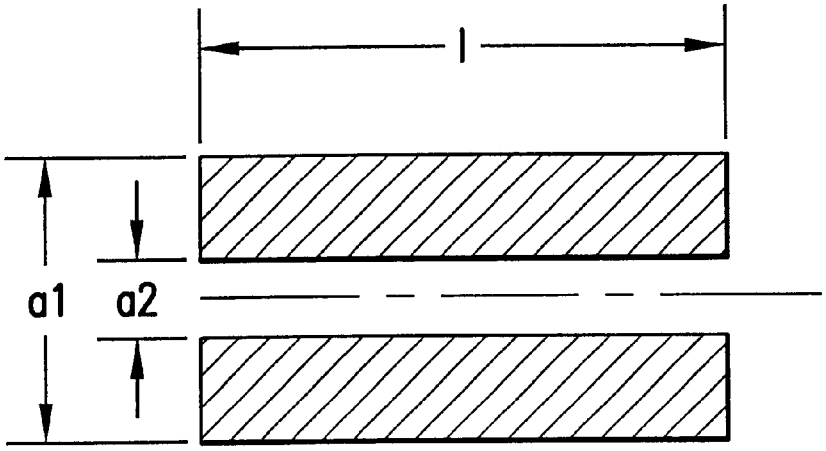
FIG. 12 shows illustrative size of a core.

If, by way of an embodiment of the present invention, illustrative values of the core shown in FIG. 12 are found, such that length of the core 1=4 cm, outer diameter a1=2.5 cm, inner diameter a2=0.5 cm and saturation magnetic flux density =1.4 Tesla, saturation magnetic flux density of the core Φmax is as given by the equation (20):

$$\Phi\max = 1.4\times1.0^{-2}\times4.0^{-2} = 5.6\times10^{-4}VS \tag{20}$$

This exceeds the value of the above equation (19).

With the shape shown in FIG. 12 (length of the core 1=4 cm, outer diameter a1=2.5 cm, inner diameter a2=0.5 cm and saturation magnetic flux density=1.4 Tesla), the current Ic of the circuit corresponding to coercivity is derived from the equation (7) as indicated by the equation (21):

$$\begin{aligned} Ic &= 2\pi\langle r\rangle\cdot Hc \\ &= 2\pi\times7.5^{-3}\times30\ (\text{A/m}) \\ &= 1.4\times10^{-1}\ \text{A} \end{aligned} \tag{21}$$

In the above equation (21), <r> is a mean radius of the core and set to 0.75 cm.

Thus, if such core is used, there is produced a difference which is only 0.14 A at the maximum between the strands A and B. This is an extremely small current value as compared to the value of the current of 50 A which should be caused to flow. Thus the problem of current imbalance can be deemed to be substantially eliminated.

Moreover, the coercivity value of 1000 Hz is used for this, as explained in connection with the equation (16). That is, the present method can be used up to an extremely high frequency, such that the commercial frequency can be coped with.

The device size capable of balancing the strand current is now considered.

If the above-mentioned coil having the self-inductance of 1H is made up of 1,000 strands through each of which flows the current of 50 A, the magnetic energy of the coil EM can be represented by the equation (22):

$$\begin{aligned} EM &= \frac{1}{2}L\cdot I^2 = \frac{1}{2}\times1\times(50\times1000)^2 \\ &= 1.25\ \text{GJ} \end{aligned} \tag{22}$$

The coil is the largest class superconducting coil in the world under the present state. As a coil of the comparable parameter, there is known a device termed "ITER" utilized for confining the nuclear fusion plasma. For this, about 20 coils having a height of approximately 15 m, a transverse width of approximately 10 m and a thickness of approximately 1 m are scheduled to be used.

On the other hand, the current balancing device utilizing the core proposed by the present invention is in need of 500×500 cores, since 1,000 strands, for example, are provided.

If the insulation space for neighboring cores is also taken into account, the space required by a sole core is as given by the equation (23):

$$3.5\ \text{cm}\times 3.5\ \text{cm}\times 6\ \text{cm}=7.35\ \text{cm}\times 10^{-5} m^3 \quad (23)$$

Therefore, such size represents a device of a volume significantly smaller than the coil and raises practically no problem.

Figure 8:
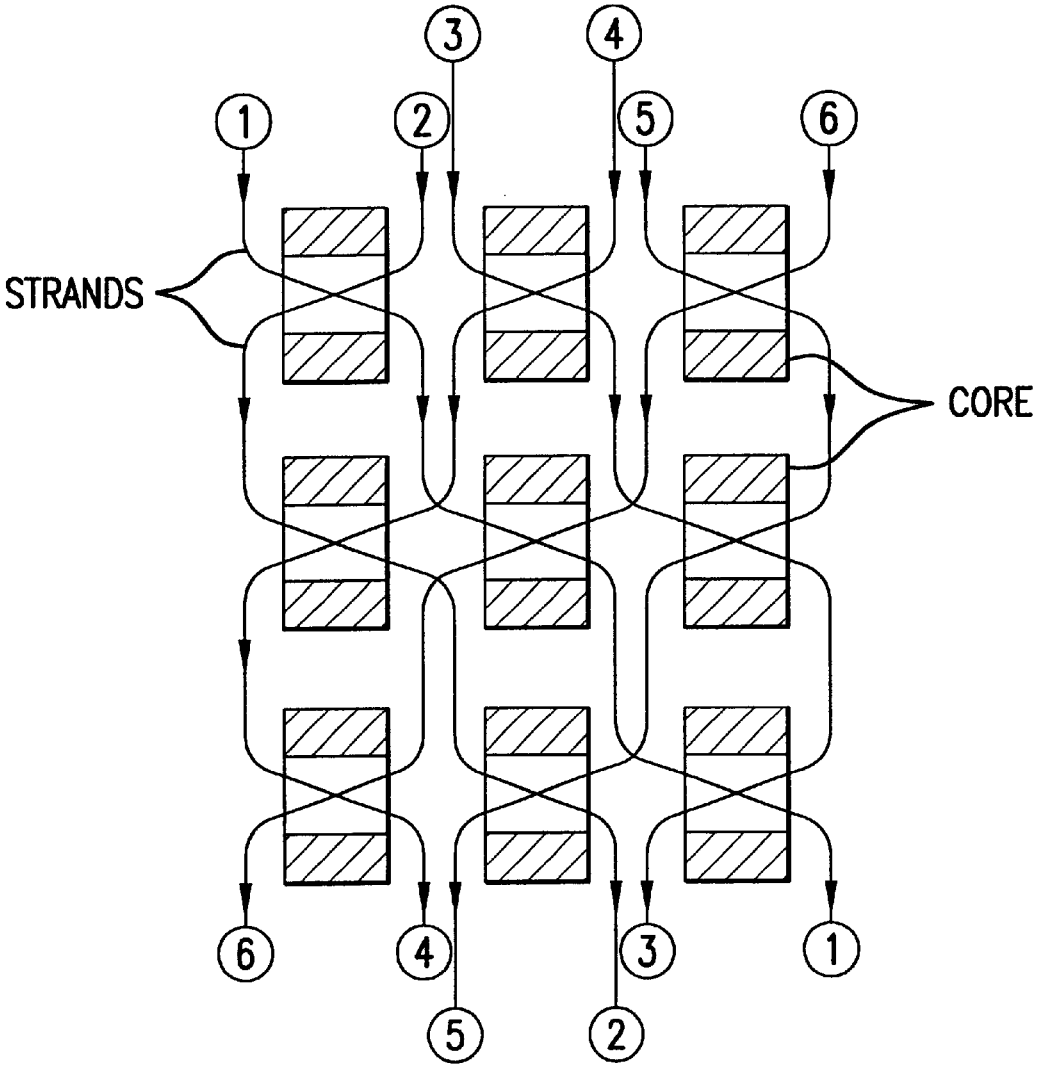
FIG. 8 is shows an illustrative arrangement between the cores and the strands according to the present invention.
Figure 14:
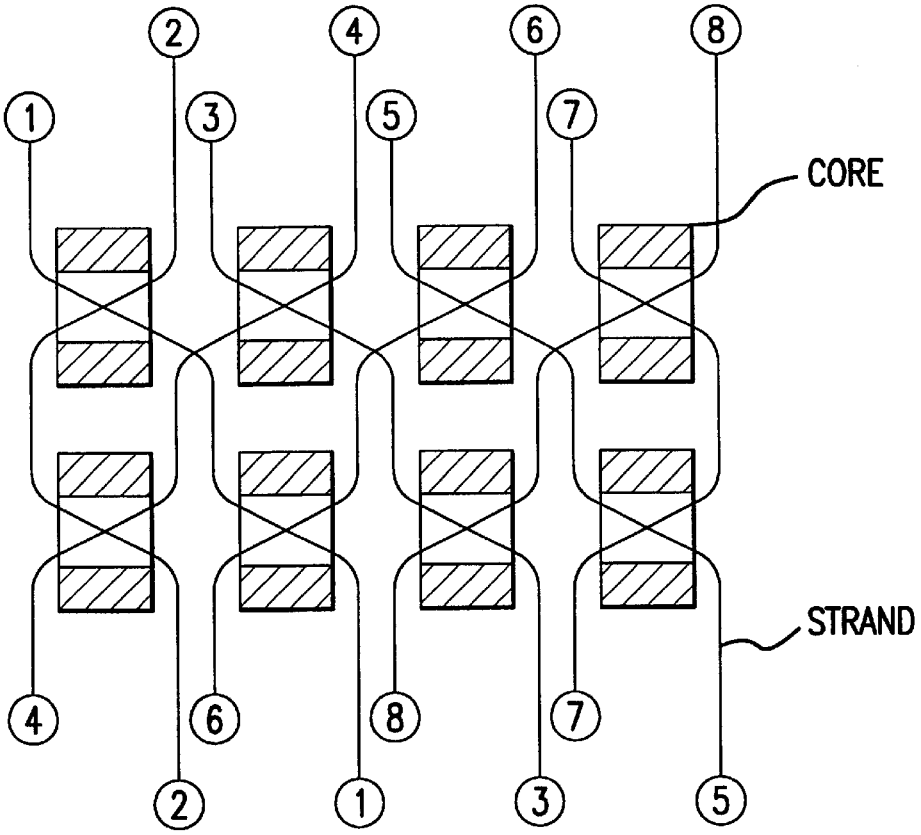
FIG. 14 illustrates another embodiment of the present invention.

Referring to FIG. 14, a modified embodiment of the present invention will be explained. In the resent embodiment, shown in FIG. 14, 2n number of strands of from (1) to (8) are passed through the hollow central portions of cores arrayed in a paired configuration of 2 rows by n columns so as to allow the currents to flow in opposite directions. In FIG. 14, n is set to 4 for simplification. In the resent modification, the number of cores can be significantly reduced for prohibiting the current imbalance as compared to the array configuration of the cores shown in FIG. 8. The number of cores of 500×500=250,000, which would be required in the above-described n×n core array, can be reduced by a factor of 1/250, that is, to 2×500=1,000. It is noted that the ITER coil will be designed with a strand number of up to about 1,024.

For arraying the strands, provided that 2n strands are numbered $I_1$ to $I_{2n}$ from a lateral side, neighboring pairs of strands passing through the cores arranged in the first stage (row) of the cores arrayed in a 2-row by n-column configuration are numbered as ($I_i$, $I_{i+1}$), wherein pairs of strands passing through (the center of) the cores arranged in the second stage (row) form a combination of ($I_i$, $I_j$) where j−i=2n−3 except on both lateral sides. In such case 2n coils suffice. In the case of FIG. 14, 2n is 8, and 2n−3 is 5.

In other words, the strands/cores arrangement is expressed as follows. In the core array of p rows×q columns (termed as "p×q array"), each core can be identified by [k,m]. One pair of strands pass in mutually opposite directions through one core [k,m] of the kth row (e.g., 1st row), any one (each) of which paired strands passes, in the subsequent row (e.g., 2nd row), either core [k+1, m−1] or core [k+1, m+1], that is, a core in the neighboring column to the column where said one core [k,m] is disposed. However, on both the lateral end rows, one of paired strands passes [k+1, m+1] (i.e., a core of subsequent row in the same column) in a reversed direction to the case of core [k,m]. Accordingly, the current imbalance between the strands $I_1, I_2, \ldots I_i, I_{i+1}, \ldots, I_{2n}$ can be significantly suppressed and reduced.

Figure 15:
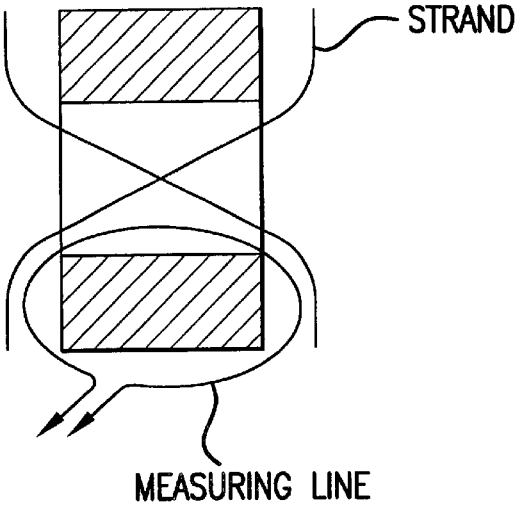
FIG. 15 illustrates still another embodiment of the present invention.

In a further modification of the present invention, measurement line (cable) for detecting the quenching is turned around the core a pre-determined number of times, which allows detection of the quenching voltage for the strand, as shown in FIG. 15. If the number of turns of the cables is 10, for example, the quenching voltage can be measured as a value ten times the actual value, thus facilitating the measurement.

Figure 16:
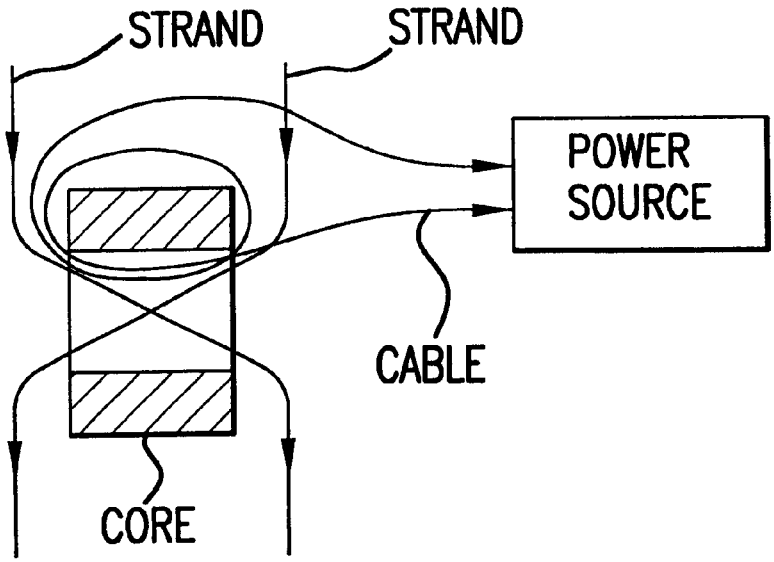
FIG. 16 illustrates yet another embodiment of the present invention.
Figure 17:
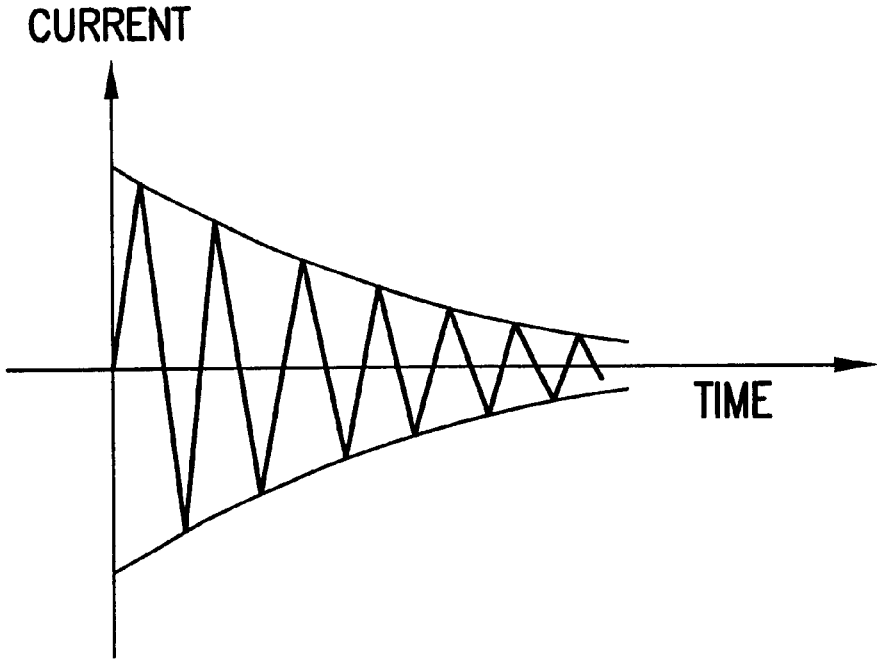
FIG. 17 illustrates a waveform of the current used for resetting the core.

As a still further modification of the present invention, there is shown in FIG. 16 a circuit structure in which a power source is connected to the ends of a measurement line for detecting the quenching, the current shown by the current waveform in FIG. 17 is caused to flow from the power source during no current is flowing in the strand, whereby the core is reset. With such circuit structure, the cores can be reset to the origin of the B-H curve as shown in FIG. 10 after the current supply to the strands comes to a close, thus stabilizing subsequent current supply.

It should be noted that modifications which are apparent to the person skilled in the art can be made without departing from the gist and scope of the present invention as disclosed and claimed herein.

What is claimed is:

1. A superconductor system, wherein the superconducting conductor comprises two strands arranged so as to pass through a single hollow portion of a substantially cylindrical hollow magnetic member so that current will flow in said strands in mutually opposite directions.

2. The superconducting conductor system as defined in claim 1, wherein said strands are driven by a commercial power source.

3. The superconducting conductor system as defined in claim 1, wherein said magnetic member is formed of a soft magnetic material.

4. The superconducting conductor system as defined in claim 1, wherein said magnetic member is formed of a wound core.

5. The superconducting conductor system as defined in claim 1, wherein at least one of said strands comprises a conductor electrically connected to said system and electrically insulated from other strands.

6. The superconducting conductor system as defined in claim 5, wherein said magnetic member is cooled to a pre-determined temperature.

7. The superconducting conductor system as defined in claim 1, wherein said strands are electrically insulated.

8. The superconducting conductor system as defined in claim 1, wherein at least one of said strands comprises a superconducting conductor set in a superconducting state.

9. The superconducting conductor system, wherein the superconducting conductor comprises n pairs of strands totaling at 2n strands arranged as pairs so as to pass through each of hollow portions of substantially cylindrical hollow magnetic members in an n×n array so that current will flow in each pair of said strands in mutually opposite directions.

10. A superconducting conductor system, wherein the superconducting conductor comprises a plurality of (2n) lead wires making up current lead(s) adapted for electrically interconnecting a driving source and a superconducting coil arranged for passing through each of hollow portions of substantially cylindrical hollow magnetic members without being bundled together, said magnetic members being arranged in an n×n array.

11. A superconducting conductor system comprising a plurality of (2n) lead wires making up a current lead adapted for electrically interconnecting a driving source and a superconducting coil and arranged for being passed through each of hollow portions of substantially cylindrical hollow magnetic members without being bundled together, said magnetic members being arranged in a configuration of two rows by n columns.

12. The superconducting conductor system as defined in claim 11, wherein two strands are arranged in a hollow portion of the magnetic member so that current will flow in mutually opposite directions.

13. A superconducting conductor system comprising a plurality of (2n) lead wires making up a current lead adapted for electrically interconnecting a driving source and a superconducting coil and arranged for being passed through each of hollow portions of substantially cylindrical hollow magnetic members without being bundled together, said magnetic members being arranged in a configuration of two rows by n columns, wherein said strands are arranged such that, when said 2n strands are numbered $I_1$ to $I_{2n}$ from a lateral side, neighboring pairs of strands passing through substantially cylindrical hollow magnetic members arranged in the first row of the magnetic members arrayed in a 2-row by n-column configuration are defined as ($I_i$, $I_{i+1}$), the pairs of strands passing through the magnetic members arranged in the second row forming a combination of ($I_i$, $I_j$) where j−i=2n−3 except on both lateral side rows so as to suppress current imbalance between the strands.

14. A superconducting conductor system comprising a plurality of (2n) lead wires making up a current lead adapted for electrically interconnecting a driving source and a superconducting coil and arranged for being passed through each of hollow portions of substantially cylindrical hollow magnetic members without being bundled together, said magnetic members being arranged in a configuration of two rows by n columns, further comprising a measurement conductor detecting quenching, said conductor being wound on said magnetic member a pre-determined number of turns.

15. A superconducting conductor system comprising two strands arranged so as to pass through a hollow portion of a substantially cylindrical hollow magnetic member so that current will flow in said strands in mutually opposite directions; and a quenching detection device having a pre-determined number of turns of a cable provided on said magnetic member; and means for resetting said magnetic member by allowing alternating current to flow from a current source when the current is not flowing in said strands, said alternating current being attenuated at a pre-determined attenuation rate.

16. The superconducting conductor system as defined in claim 15, wherein said magnetic member is a soft magnetic material.

17. The superconducting conductor system as defined in claim 15, wherein said magnetic member is formed as a wound core.

18. A superconducting conductor system comprising hollow magnetic cores arranged in an array of p rows×q columns, and q pairs of strands (2q strands) arranged to pass through each of said magnetic cores in pair of two strands in mutually opposite directions, wherein a core array position is expressed as [k,m], one pair of strands passing through a core [k,m] in mutually opposite directions, and either one of said paired strands which passes through the core [k,m] passes either core [k+1, m−1] or [k+1, m+1] in a subsequent row, provided that a strand arranged to pass a core on a lateral side end row passes a core of [k+1, m] in a subsequent row on the same column in a reversed direction to said core [k,m].

* * * * *